US008382331B2

(12) United States Patent
Cheng

(10) Patent No.: US 8,382,331 B2
(45) Date of Patent: Feb. 26, 2013

(54) LED LIGHTING LAMP

(76) Inventor: Yung Pun Cheng, Macau (CN)

( * ) Notice: Subject to any disclaimer, the term of this patent is extended or adjusted under 35 U.S.C. 154(b) by 763 days.

(21) Appl. No.: 12/506,188

(22) Filed: Jul. 20, 2009

(65) Prior Publication Data

US 2010/0254133 A1 Oct. 7, 2010

Related U.S. Application Data

(60) Provisional application No. 61/166,577, filed on Apr. 3, 2009.

(51) Int. Cl.
*F21V 29/00* (2006.01)

(52) U.S. Cl. ..... 362/294; 362/800; 362/249.02; 362/249.11

(58) Field of Classification Search ..... 362/294, 362/249.02, 249.1, 249.11
See application file for complete search history.

(56) References Cited

U.S. PATENT DOCUMENTS

| | | | | |
|---|---|---|---|---|
| 7,093,952 | B2 * | 8/2006 | Ono et al. | 362/194 |
| 7,665,864 | B2 * | 2/2010 | Zheng et al. | 362/249.11 |
| 7,699,498 | B2 * | 4/2010 | Zheng | 362/249.02 |
| 7,753,560 | B2 * | 7/2010 | Xu et al. | 362/294 |
| 7,758,211 | B2 * | 7/2010 | Zheng et al. | 362/249.02 |
| 7,862,210 | B2 * | 1/2011 | Zhang et al. | 362/294 |
| 7,914,178 | B2 * | 3/2011 | Xiang et al. | 362/294 |
| 2005/0169006 | A1 * | 8/2005 | Wang et al. | 362/555 |
| 2009/0316403 | A1 * | 12/2009 | Zhang et al. | 362/249.01 |

OTHER PUBLICATIONS

PCT/CN2009/000927, International Search Report and Written Opinion of the International Searching Authority mailed Jan. 7, 2010.

* cited by examiner

*Primary Examiner* — Jong-Suk (James) Lee
*Assistant Examiner* — Leah S Macchiarolo
(74) *Attorney, Agent, or Firm* — Baker & McKenzie LLP

(57) ABSTRACT

LED lighting lamps provide improved heat dissipation efficiency, wide illumination beam angles, and substantially uniform illumination intensity. Generally, the disclosed LED lamps comprise at least one LED lighting element mounted on at least one stand and a two-level heat dissipation mechanism.

66 Claims, 9 Drawing Sheets

LED LIGHTING LAMP

CROSS-REFERENCE TO RELATED APPLICATIONS

This application claims priority to U.S. Provisional Application Ser. No. 61/166,577, filed on Apr. 3, 2009, and entitled "LED Lighting Lamp," which is incorporated herein by reference for all purposes.

BACKGROUND

1. Technical Field

The present disclosure generally relates to light-emitting diode (LED) lamps. More specifically, the present disclosure relates to LED lamps with high heat-dissipation efficiency.

2. Background

With recent developments in LED technologies, high-powered LED lamps are more frequently designed for use in household lighting applications. Compared with light sources currently used in homes, such as incandescent lights, LED lamps provide advantages such as ample brightness, energy savings, high reliability, and long life span.

Current commercially available LED lamps involve a plurality of packaged LEDs arranged in an array on a plane. Although this type of LED lamp may meet common lighting needs, the LED lighting elements are distributed on the same plane and, thus, the light being radiated from the LED lamp is highly directional and has a relatively narrow beam angle. In addition, this type of LED lamp lacks a good heat-dissipation structure which limits the life span due to the LEDs overheating. The heat dissipation issue may be at least partially addressed by installing a radiator on the back of the base plane. For high-powered LED lighting elements, however, the packaging, including the adhesive base and the glass bubble, may still interfere with effective heat dissipation.

Accordingly, there is a need for an LED lamp with good heat-dissipation efficiency and wide illumination beam angles.

BRIEF SUMMARY

This disclosure pertains to LED lamps, and in particular to LED lamps with a multi level heat dissipation mechanism. The LED lamps provide sufficient heat-dissipation efficiency, wide illumination beam angles, and minimal wasted light.

According to an aspect, an LED lamp includes a first level heat sink, a second level heat sink, and an LED light element. The first level heat sink comprises a substrate and the second level heat sink comprises a stand connected to the substrate. An LED light element is mounted on the stand.

According to another aspect, an LED lamp includes an LED element, a substrate and a stand. The stand is connected to the substrate and the LED is mounted on the stand. The stand is operable to raise the LED element above a top surface of the substrate.

According to another aspect, an LED lamp includes at least one LED light element, a first level heat sink, and a second level heat sink. The first level heat sink comprises an LED support and the LED light element is mounted on the LED support. The second level heat sink comprises a substrate and the LED support is connected to the substrate.

According to another aspect, an LED lamp includes an LED emitting unit, an LED light element, and a substrate. The LED emitting unit includes an LED stand and two electrical terminals. An LED light element is mounted on the LED stand. The substrate comprises a slot and the bottom portion of the LED emitting unit is inserted into the slot.

DETAILED DESCRIPTION

Known LED lamps lack good heat-dissipation efficiency and wide illumination beam angles, and often waste light. To address common lighting needs, a plurality of LEDs may be arranged in an array on a plane, as disclosed in Chinese Pat. App. No. 01103850.0 (Pub. No. 1372096), entitled "LED Illumination Lamp" to T. Wang. In this configuration, a plurality of LEDs are installed with a sealing adhesive on planar base plates of an LED lamp housing and printed circuit boards are installed between the housing and lamp cap. This arrangement lacks adequate heat-dissipation limiting the lamp's lifespan. This arrangement also suffers from inadequate breadth of illumination angles.

To address the narrow beam angle design, a plurality of LEDs may be used in conjunction with an LED carrier, as disclosed in Chinese Pat. App. No. 200710044917.1 (Pub. No. 101182916), entitled "LED Lamps," by X. Zhan. Zhan discloses an LED carrier with multiple LED bearing planes—one of which is planar and another of which is inclined. LEDs are then distributed on the planes in a circle, at angularly equidistant points, which expands the beam angles but, due to the discontinuity between the inclined planes, and the LEDs on the inclined planes being on a spherical surface, the illumination intensity is still non-uniform.

Another issue with known LED lighting applications is the inefficient use of output light from LED lighting elements. LED lighting elements typically emit light not only from the top of the element but also from the sides. If an LED lighting element is directly mounted on a plane, the light output in directions other than from the top may be wasted. As the result the total illumination output is diminished and the output light has a narrow beam angle, directed primarily in the perpendicular direction relative to the top of the lighting element.

One or more embodiments disclosed herein maximize heat-dissipation efficiency while minimizing wasted light, providing wide illumination beam angles, and substantially uniform illumination intensity.

As discussed herein the distance between an LED an the central longitudinal axis of an LED lamp refers to the shortest distance between the LED and the central longitudinal axis of the LED lamp.

Figure 1:
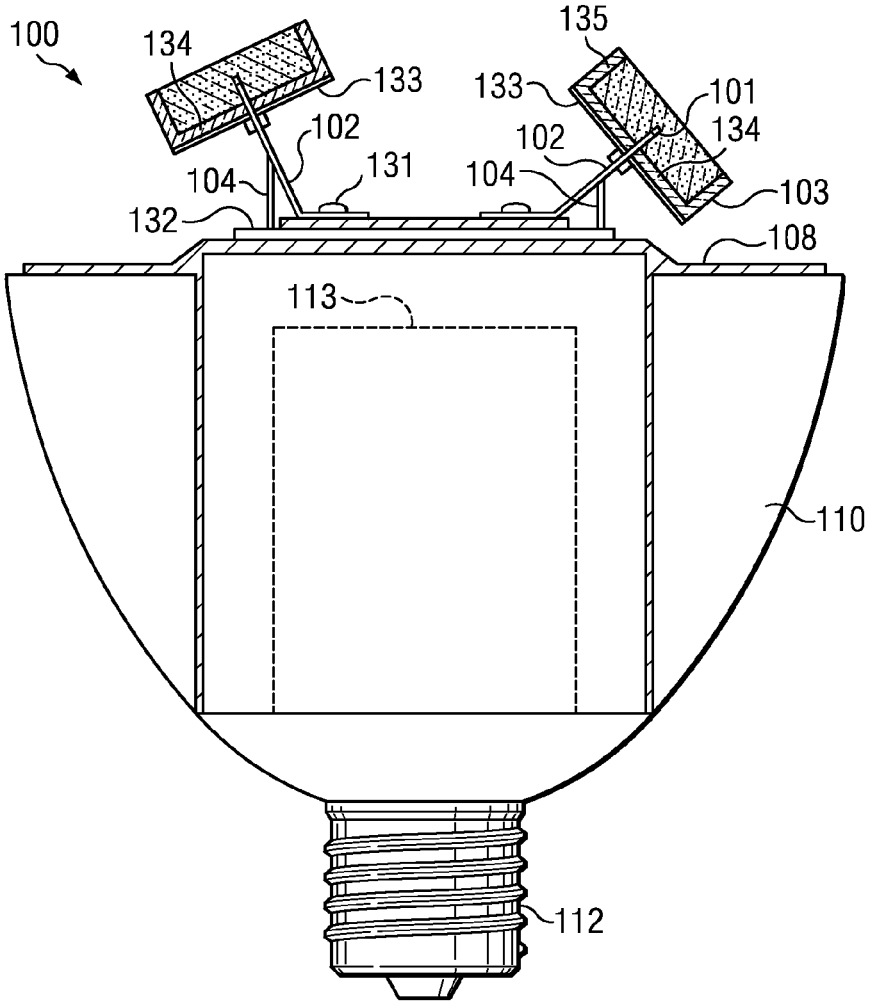
FIG. 1 is a drawing illustrating a cross-sectional side view of an LED lamp, in accordance with the present disclosure.

FIG. 1 is a drawing illustrating a cross-sectional side view of an embodiment of an LED lamp 100. A lamp holder 112 is connected to an alternating current (AC) power source (not shown) to supply power to the LED lamp 100. The lamp holder 112 may be configured to have the same outward form as common lighting lamps, making it easier to substitute the LED lamp 100 in for a bulb currently used for household or other lighting applications. A substrate 108 is mechanically connected to the lamp holder 112. An internal direct current (DC) circuit board 113 is placed inside the substrate 108, and draws power from the lamp holder 112 to supply to the LED lighting elements 101.

The substrate 108 may be a cast-formed metal module. The substrate 108, which serves as a heat sink, may include a plurality of fins for heat dissipation. The fins may be oriented on the sides 110 or top (not shown in FIG. 1) of the LED lamp 100 to facilitate air flow so that heat can be more effectively dissipated.

LED lighting elements 101 are installed on LED stands 102. LED stands 102 may serve as an additional heat sink and are connected to substrate 108. The connection may be achieved through any known methods in the field which permit the LED stand 102 to rest stably upon substrate 108. The LED stand 102 may be made from any good heat conducting material. In an embodiment, LED stand 102 is made from the same material as substrate 108. In another embodiment, LED stand 102 and substrate 108 are made from different materials, but both materials have adequate heat dissipation characteristics.

In an embodiment LED stand 102 is a metal frame and has a thickness of 0.5-3 mm. LED lighting element 101 may be attached to the LED stand 102 in a variety of ways. In an embodiment, LED lighting element 101 is attached to the LED stand 102 via an adhesive paste with good heat-conducting properties (e.g., silver epoxy). This provides good heat transfer from the LED lighting element 101 to the LED stand 102. The LED stand 102 may serve as both a mechanical support and a heat conduit for the LED lighting element 101. In an embodiment, the LED lighting elements 101 are bare (i.e. without normal LED packaging apparatus such as the adhesive base, heat-dissipating substrate, pins, or glass fixture). Using bare LED lighting elements 101 may improve heat dissipation.

The LED stand 102 may be fixed to the substrate 108 by a screw 131. Electrical terminals 104 are connected to a printed circuit board (PCB) 132. In an embodiment, the PCB 132 is a circular ring-shaped PCB. The PCB 132 connects to the internal DC supply board 113, allowing electric current to be supplied to the LED elements 101 via the electric terminals 104.

Depending on the design considerations for the output light intensity of the LED lamp 100, the number of LED elements 101, LED stands 102 and electric terminal pairs 104 may be adjusted.

A transparent container 103 has a bottom 134 and sides 135 surrounding the LED lighting element 101. The transparent container 103 can provide protection for the LED lighting element 101. In an embodiment, the sides of the transparent container 103 are round. The transparent container 103 can be made from any transparent materials commonly used in the art, e.g., glass, plastic or nylon. In an embodiment, the transparent container 103 is made from transparent plastic. The transparent container 103 can be configured to provide additional reflection and refraction of light emitted from the LED lighting element 101. A thin sheet 133 may also be attached to a bottom surface 134 of the transparent container 103 to reflect the light emitted by the LED lighting element 101 to output light for the LED lamp 100. The thin sheet 133 may be a high-gloss, shiny, thin sheet. Sheet 133 may be in silver, gold or any other color and may help to adjust the color temperature of the LED lamp 100.

An LED lighting element 101 mounted on an elevated platform, such as the LED stand 102, allows for more of the light output in the horizontal directions to be turned into useful output light. An LED stand 102 can be configured to allow for the overall beam angle of the output light to be increased (e.g., from 140 degrees to more than 180 degrees). E.g., changing the position of the LED stands 102 on the LED lamp 100 changes the beam angle of the output light of the LED lamp 100.

The LED lamp 100 is operable to allow for multi-level heat dissipation, i.e. dissipating heat in multiple stages. The LED stand 102 can serve as one level of heat dissipation (or a first level heat sink) by substantially reducing the temperature of the LED 101 through heat conduction in the LED stand 102. The substrate 108 can serve as another level of heat dissipation (or a second level heat sink) by substantially reducing the temperature of the LED through heat conduction in the substrate 108. In other words, the LED stand 102 provides a first stage of heat dissipation and the substrate 108 provides a second stage of heat dissipation to further lower the temperature of the LED 101. This provides greater heat dissipation efficiency. The LED stand 102 is also free standing in the air and transfers heat to the air around it easily, further improving heat dissipation. Thus, the LED lamp 100 can dissipate the heat generated by the LED light element at a plurality of levels.

Another advantage of the two-level heat dissipation mechanism is that the temperature of the second-level heat sink, substrate 108, may be maintained at a lower level than the temperature of the first-level heat sink, the LED stand 102. The substrate 108 forms part of the outer surface of the LED lamp, and therefore could be touched by users during the course of normal use and handling of the LED lamp. By implementing a two level heat dissipation mechanism, the safety profile of the LED lamp may be improved. This may help the LED lamp meet necessary safety standards for sale in the marketplace. In an embodiment, the LED lamp 100 may be left on continuously for a period of around a week, with the temperature of the LED stand 102 maintained around 120° C., while the substrate 108 is maintained at a lower temperature level, such as below 90° C. The difference in temperature may be varied, based on the difference in the physical shape, the heat dissipation ability of the two heat sinks, and the proximity of LED stand 102 to the LED lighting elements 101 generating the heat.

Figure 2A:
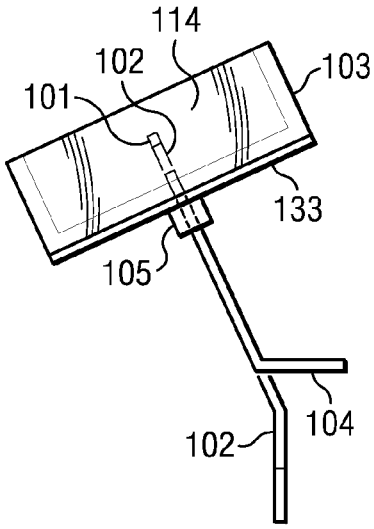
FIGS. 2A and 2B are drawings illustrating a side view and a front view of the LED stand shown in FIG. 1, in accordance with the present disclosure.
Figure 2B:
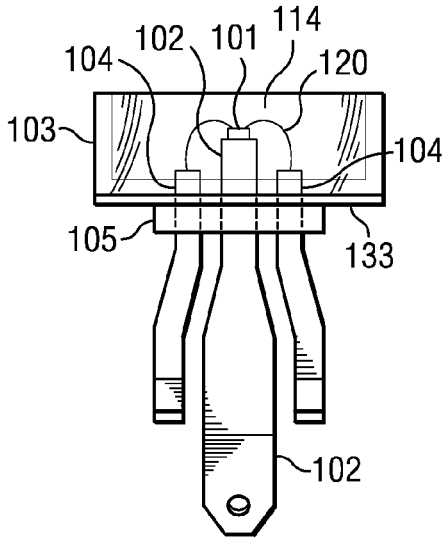

FIGS. 2A and 2B are drawings illustrating a side view and a front view of LED stand 102. LED stand 102 may have multiple supporting legs or prongs. In an embodiment, LED stand 102 has three supporting prongs, one for supporting LED lighting element 101, and the other two prongs connected to two electrical terminals 104, which supply electrical current to the LED lighting element 101. The LED element 101 is mounted on the LED stand 102. There are two or more wires 120 connecting electric terminals 104 to the LED lighting element 101. Transparent container 103 may provide protection for the wires 120. The wires 120 may be gold wires. In an embodiment, the transparent container 103 is filled with transparent silicon rubber 114. The transparent container 103 and the silicon rubber 114 may help to reflect and refract the light emitted from the LED lighting elements 101 into many directions. A holder 105, made of non-conductive materials, helps hold the LED stand 102, the electric terminals 104 and the transparent container 103 in desired positions. The bottom 134 of the container 103 includes an aperture defined therethrough. The prongs of LED stand 102 are disposed through the aperture and are held in place by the holder 105, e.g., in an embodiment, the holder 105 is a stopper and the prongs are disposed through and fit snugly in the stopper. The holder 105 is coupled to the container 103 by any mechanical coupling known in the art or by an adhesive. The perimeter of the aperture in the bottom 134 may have a number of profiles, including an oblong profile. In another embodiment, the bottom of the container 103 includes three apertures defined therethrough. Each prong of the LED stand 102 are disposed through a different aperture and are held in place by the holder 105.

The LED stand 102 may be positioned at different inclined angles. LED lighting element 101 is mounted on the top of the central supporting prong of stand 102 and, thus, is raised above the substrate 108. The central prong of stand 102 (on top of which the LED lighting element 101 is mounted) extends above the bottom plane of container 103. In an embodiment, the central prong may extend 0.5 to 3 millimeters above the bottom plane of container 103. The tops of terminals 104 may also extend above the bottom plane of container 103. In an embodiment, the terminals 104 do not rise above the height of the LED lighting element 101.

A thin sheet 133 may be attached to the bottom plane of the transparent container 103. The sheet 133 may be glossy and reflective. A holder 105, made of non-conductive materials, may help to hold the LED stand 102, the electric terminals 104, and the transparent container 103 in position.

Figure 3:
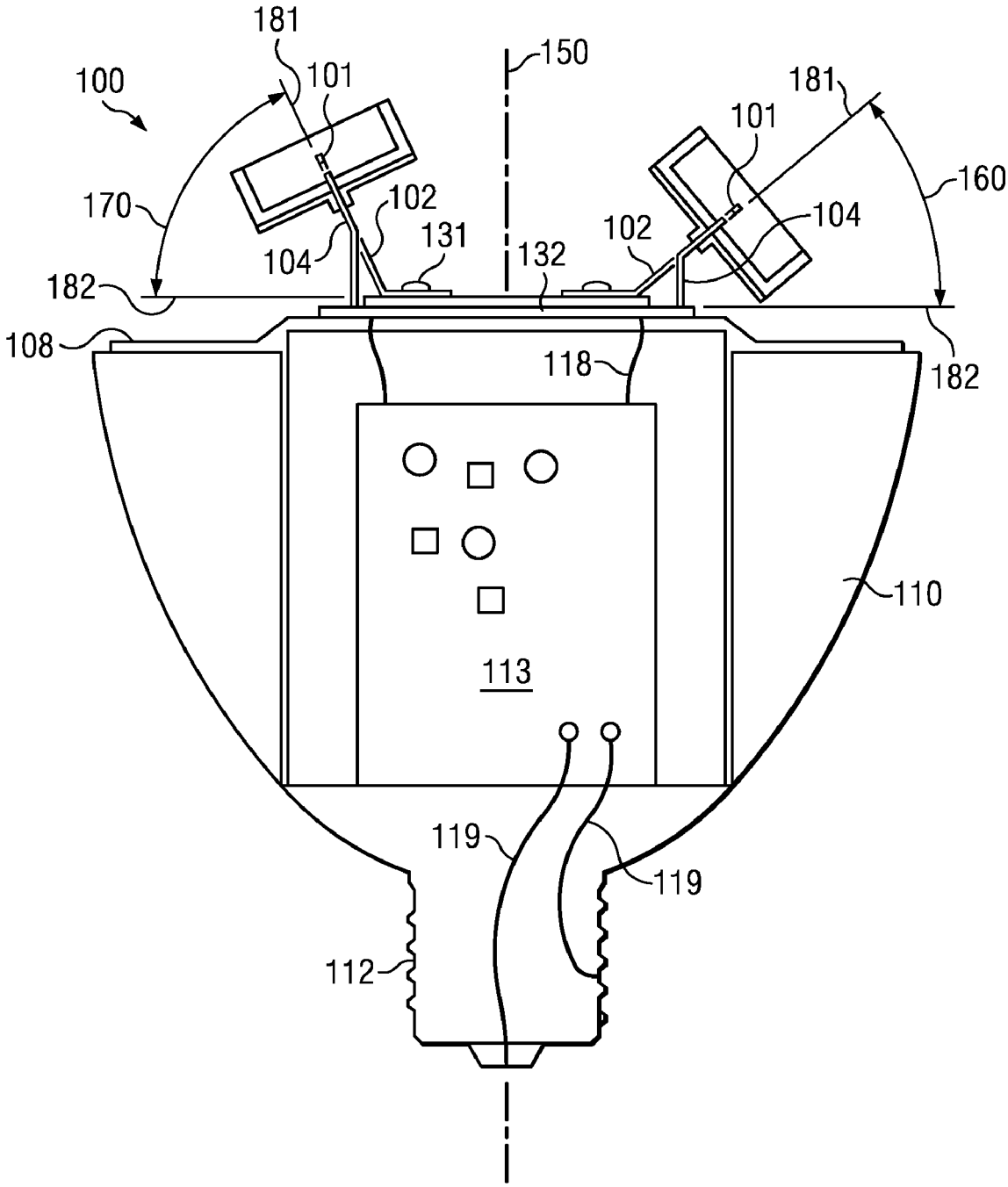
FIG. 3 is a schematic drawing illustrating internal electrical connections of the LED lamp shown in FIG. 1, in accordance with the present disclosure.

FIG. 3 is a drawing illustrating an LED lamp 100 with two LED stands 102 positioned at two different angles 160 and 170 defined by a line parallel to the central axis of the LED stands 181 and a line parallel to the top surface of the substrate 182. The LED stands 102 may be fixed to the substrate 108 by a screw 131. In an embodiment, angles 160 and 170 are both within the range of 10° to 80° relative to line 182. Line 182 is perpendicular to the longitudinal axis 150 of the LED lamp. Mounting the LED elements 101 on stands 102 oriented at different angles may allow the LED lamp 100 to provide a wider scope of light coverage and a wider beam angle for the output light.

FIG. 3 also illustrates the internal electrical connections of the LED lamp 100 of the present disclosure. A DC circuit board 113 may be installed in the internal cavity of the LED lamp 100. The DC circuit board 113 may be a PCB and would include an AC to DC converter. Such AC to DC converters are well known in the field. The DC circuit board 113 also includes a current-control part (not shown in FIG. 3) for each LED lighting element. The input terminal of the converter connects with the lamp holder 112 by a conducting wire 119 in order to receive an input AC current. The output terminal of the converter provides DC current to LED lighting elements 101 through a DC wire 118, power distribution PCB 132, and then through the terminals 104 and the bonding wires (not shown in FIG. 3). Two DC wires 118 connect with the PCB 132, which provides power to the electrical terminals 104 of the LED stands.

Figure 4:
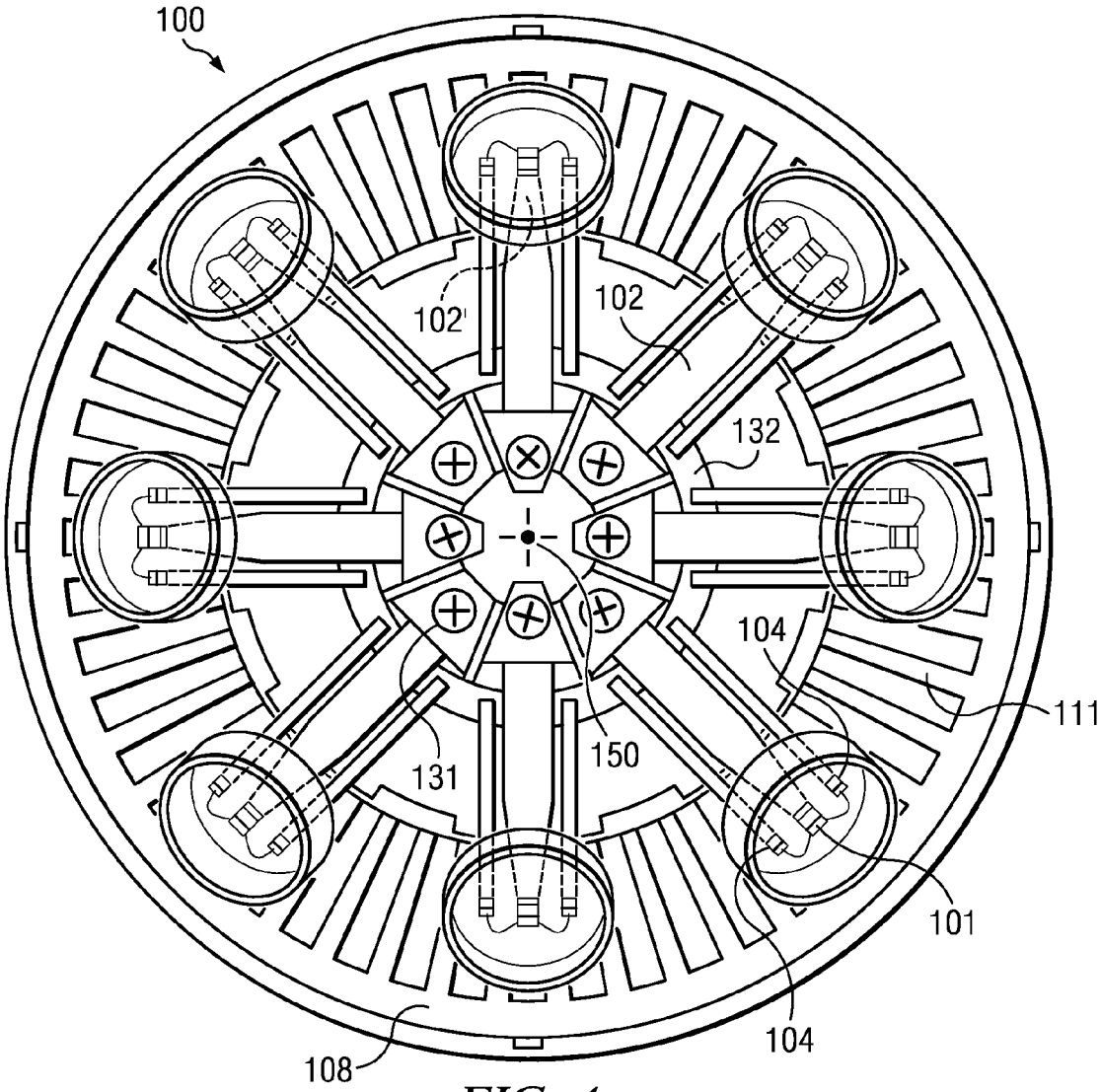
FIG. 4 is a drawing illustrating a top down view of the LED lamp shown in FIG. 1, in accordance with the present disclosure.

FIG. 4 is a drawing illustrating a top-down view of an embodiment of an LED lamp 100. The LED stands 102 are fixed to the substrate 108 by a screw 131. Substrate 108 has fins 111 for improved heat dissipation as discussed above. Electrical terminals 104 are connected to a printed circuit board (PCB) 132. In the illustrated embodiment, the PCB 132 is a circular ring-shaped PCB. The PCB 132 allows electric current to be supplied to the LED elements 101 via the electric terminals 104. LED lighting elements 101 on the LED stands 102 and 102' are located on circles of different radii around the longitudinal axis 150 of the lamp 100. In other words, the distance between the LED lighting elements on the LED stands 102 and the longitudinal axis 150 is greater than the distance between LED lighting elements on the LED stands 102' and the longitudinal axis 150. Further, the inclination angle of the LED stand 102' is greater than the inclination angle of the LED stands 102.

In an embodiment, the positioning and orientation of the LED stands 102 are arranged in such a manner that each stand has a different inclination angle and different distance to the longitudinal axis 150 than the stands adjacent to it, but any two stands separated by one stand in between may have the same inclination angle and the same distance to the longitudinal axis 150, resulting in two levels of LED placement. I.e., the LEDs are placed in an alternating manner with a first set of LED lighting elements all at one orientation angle (comprising the first level) and a second set of LED lighting elements all at a second orientation angle (comprising a second level). As a result of such positioning, an LED lighting element on one LED stand is at a different radius and has a different inclination angle from the LED lighting element on an adjacent LED stand. This arrangement results in light emitted from one LED element being at an angle different from that of light emitted from adjacent LED elements, which provides better illumination uniformity, enhances the average illumination intensity, and expands the overall illumination beam angle. Persons skilled in the art will recognize that the pattern may be varied. For example, the pattern may be a three-level pattern or a one-level pattern. Any number of levels can be used. The pattern may be irregular instead of alternating. In another embodiment, all the stands may be located the same distance from the longitudinal axis 150 but have different orientation angles, or vice versa. In another embodiment, the LED stands at a particular level do not have to be all at the same orientation angle. The pattern in which the LED stands 102 are positioned can be made as simple or as complex as necessary in order to meet output light requirements.

Figure 5:
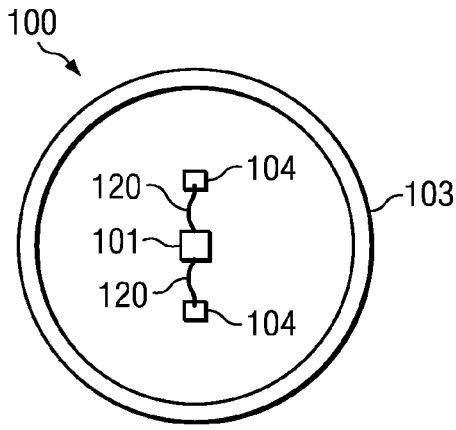
FIG. 5 is a drawing illustrating electrical installation of the LED lamp shown in FIG. 1, in accordance with the present disclosure

FIG. 5 is a drawing illustrating a top-down view of the electrical connections of an LED lamp 100. The LED lighting element 101 is connected to two power wire electric terminals 104 by two thin bonding wires 120 in order to draw power. The bonding wires 120 are preferably commonly available wires. The LED wire interfaces 104 may be metal conductors embedded in an insulating material and are electrically insulated from the substrate.

Figure 6:
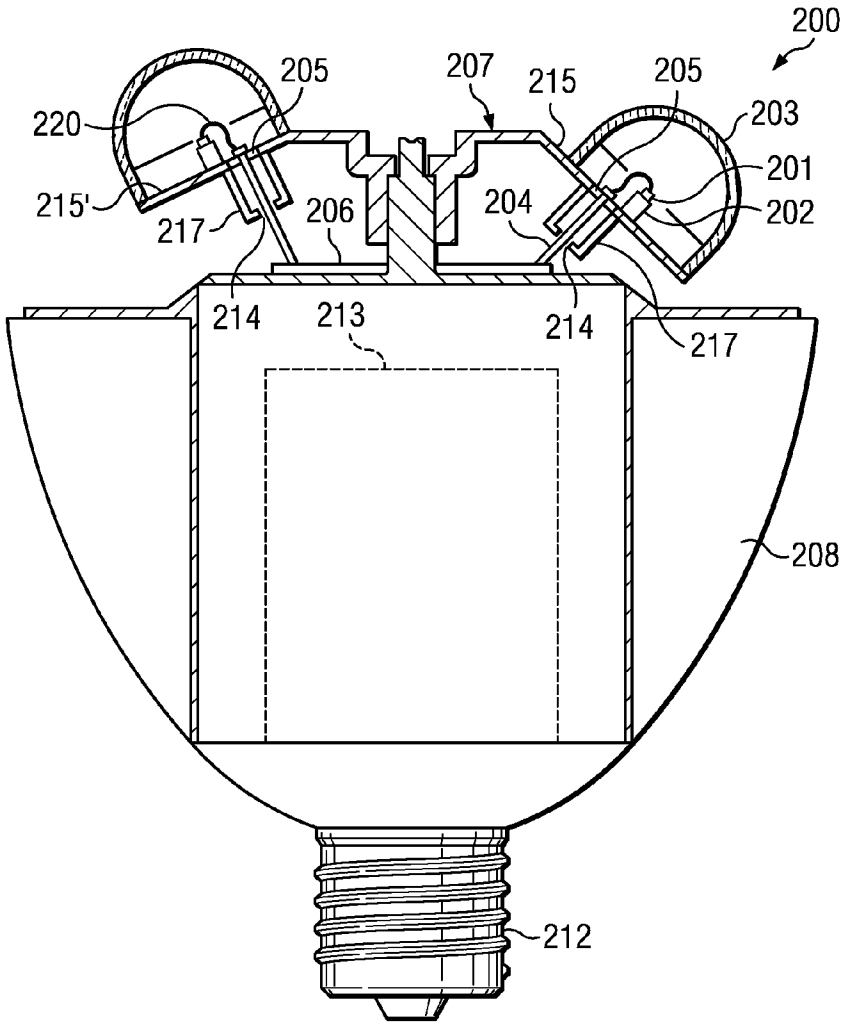
FIG. 6 is a drawing illustrating a cross-sectional side view of another LED lamp, in accordance with the present disclosure.

FIG. 6 is a drawing illustrating a cross sectional view of an embodiment of an LED lamp 200. A lamp holder 212 is connected to an alternating current (AC) power source to supply power to the LED lamp. The lamp holder 212 may be of the same outward form as common lighting lamps, making it easier to substitute the LED lamp in for bulbs currently used for household or other lighting applications. Substrate 208 is mechanically connected to the lamp holder 212. An internal direct circuit (DC) board 213 is inside the substrate 208, and draws power from the lamp holder 212 to supply to the LED lighting elements 201. Electrical terminals 204 are connected to wires 220 which are connected to LED 201. In an embodiment, the wires 220 are tiny gold wires.

Substrate 208 may be a cast-formed metal module. In an embodiment, an additional support structure 207, which may serve as an additional heat sink, is connected to substrate 208 through interface 206. The connection may be achieved through any known methods in the field that enable support 207 to rest solidly and stably on top of substrate 208, and to enable heat to be conducted efficiently from LED lighting elements 201 to substrate 208. In an embodiment, support 207 is made from the same material as the substrate 208, and is connected with a mechanical connection (e.g., a screw). In another embodiment, support 207 is made from a different material than the substrate 208, but both materials have sufficient heat dissipation characteristics.

Support 207 includes a plurality of inclined planes, of which inclined planes 215 and 215' shown in the drawing are examples. The inclined planes may be formed through mechanical machining technology. The inclined planes may also be coated, e.g., by electroplating, to increase reflectivity. Increasing reflectively of the planes improves the ability of the LED lamp to turn substantially all available output light from LED lighting elements into useful output light. Mechanical machining and electroplating may be achieved using known methods in this field.

LED lighting elements 201 are installed on some or all of the inclined planes 215. In an embodiment, LED lighting element 201 is installed on a stand 202 which forms a raised platform above the inclined plane 215. Stand 202 may serve both as a mechanical support and a heat conduit for the LED lighting element 201. The use of such a stand may improve the illumination beam angle and illumination intensity of the output light from the LED lighting element 201. In an embodiment, the LED lighting elements 201 are bare (i.e. without normal packaging such as the adhesive base, heat-dissipating substrate, pins, or a glass fixture). Such bare LED lighting elements 201 may be attached to their respective stands 202 using a heat conducting adhesive. Using bare LED lighting elements 201 may improve heat dissipation. Depending on the requirements for the output light of the LED lamp, the number of inclined planes 215 on support 207 may be adjusted. The number of LED stands 202 on each plane 215 may also be adjusted and each LED stand 202 may hold zero or one LED lighting element 201. The LED stands 202 may be placed anywhere on the inclined planes. In an embodiment, each plane has one LED stand and each LED stand has one LED lighting element 201. In another embodiment, support 207 has eight inclined planes 215, and each inclined plane 215 has one LED lighting element 201.

LED lighting elements 201 may be mounted on stands 202 and, thus, are raised above the inclined plane 215. Most LED lighting elements emit light not only from the top of the element, but also from the sides, and if an LED lighting element is directly mounted on a plane, the light output from the sides cannot be effectively used. The total illumination output may be diminished and the output light may have a narrow beam angle, or the range of angular degrees for which a lamp can produces light, directed primarily in the perpendicular direction relative to the top of the lighting element. When an LED lighting element 201 is mounted on a raised platform, however, such as on stand 202, the light output from the sides may be turned into useful output light and the LED lamp 200 may have a wider beam angle. In an embodiment, the LED lamp 200 contains LED lighting elements 201 mounted on stands 202 of a height between 0.5 and 3 mm and has a beam angle of greater than 180°. The height of the stand 202 may be adjusted depending on the specifications. In another embodiment, using a stand 202 may increase total light output by 30% and increase the overall beam angle to more than 220°.

The electrical terminals 204 are disposed through a bore (not shown) centrally defined through a stopper or holder 205. The holder 205 is disposed in a recessed area 217 of the inclined planes 215. The holder 205 has dimensions that conform to the dimensions of the recessed area 217 such that the holder 205 is securely fit in the top of the recessed area 217. The bottom wall of the recessed area 217 includes a hole 214 defined therethrough, and the hole 214 is aligned with the bore of the holder 205. The alignment of the hole 214 and the bore of the holder 205 allows the electrical terminals 204 to be disposed through the hole 214. As such, the electrical terminals 204 do not touch the recessed area 217 of the inclined plane 215, but instead are disposed inside the hole in the bottom of the recessed area 217 without touching the sides of the recessed area. The holder 205 provides electrical insulation for the electrical terminals 204 from the inclined plane 215. Wires 220 connect the top of the electrical terminals to the LED lighting element 201. The bottom of the electrical terminals 204 connect to the PCB 213 inside the substrate 208 (as discussed in reference to FIG. 9).

In an embodiment, a transparent cover 203 is provided for each lighting element 201. The transparent cover 203 may be made of any materials known in the art (e.g., glass, plastic or nylon). The cover 203 can serve to protect the lighting element 201, its stand 202 and other components, such as wires for electrical connections. In an embodiment, the transparent cover 203 is filled with transparent silicon rubber. The silicon rubber may help reflect and refract light from the LED elements 201 into many directions to provide wider light coverage. In an embodiment, transparent cover 203 includes a slot 250 to allow for air circulation within the transparent cover 203. The air circulation may serve to cool the LED elements 201.

In an embodiment, a multi-level heat dissipation mechanism is disclosed, i.e. dissipation of heat in multiple stages. Support 207 serves as the first level mechanism (or a first level heat sink) for heat dissipation and substrate 208 serves as the second level mechanism (or as a second level heat sink) for heat dissipation, providing greater heat dissipation efficacy for the LED lamp 200. In other words, the LED support 207 provides a first stage of heat dissipation and the substrate 208 provides a second stage of heat dissipation to further lower the temperature of the LED elements 201. In an embodiment, there is a gap between the inclined planes 215 of support 207 and the substrate 208, through which air can flow, further improving heat dissipation from the LED lighting elements 201. Thus, the LED lamp 200 can dissipate the heat generated by the LED light element at a plurality of levels.

The two-level heat dissipation mechanism discussed above may also allow for the temperature of the second level heat sink, substrate 208, to be maintained at a lower level than the temperature of the first level heat sink, support 207. Substrate 208 forms part of the outer surface of the LED lamp, and therefore may be touched by users of the lamp. Maintaining a lower temperature for substrate 208 so that users will not be harmed when touching it, may improve the safety profile of the LED lamp 200. In an embodiment, even after the lamp has been on continuously for a period of around a week, support 207 is at a temperature of around 80° C.-120° C., while substrate 208 is maintained at a lower temperature level, below 90° C. Even after such period of time, there is a temperature differential between support 207 and substrate 208 of about 25° C., because of the difference in physical shape between the two heat sinks, and because support 207 is closer to the LED lighting elements that are generating the heat.

Figure 7:
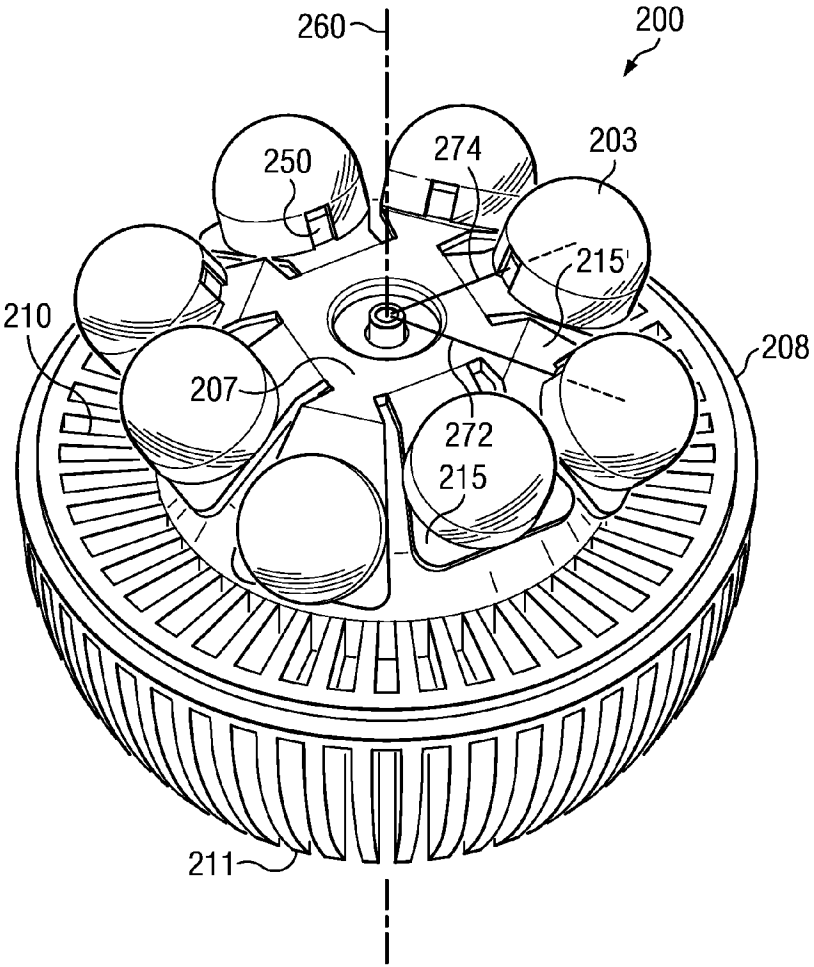
FIG. 7 is a drawing illustrating a perspective view of the LED lamp shown in FIG. 6, in accordance with the present disclosure.

FIG. 7 is a three dimensional view of an LED lamp 200. The inclined planes 215, 215' of support 207 are radially distributed around the longitudinal axis 260 of the LED lamp 200, and may have varying inclination angles (shown in FIG. 9). In an embodiment, the inclined planes 215, 215' are arranged as two "levels" of inclined planes. In the first level, every other inclined plane 215 is positioned at a first distance 272 from the longitudinal axis 260 and are positioned at a first inclination angle (shown in FIG. 9). In the second level, the remaining inclined planes 215' are positioned at a second distance 274 from the longitudinal axis 260 and are positioned at a second inclination angle (shown in FIG. 9). This arrangement will be explained in further detail in connection with FIGS. 8 and 9 below.

The substrate 208, which serves as a heat sink, includes a plurality of fins 210, 211 for heat dissipation. The fins may be oriented on the top 210 or on the sides 211 of the LED lamp substrate 208 to facilitate air flow so that heat can be more effectively dissipated. In an embodiment, a transparent cover 203 is provided for each lighting element. Transparent cover 203 may include a slot 250 to allow for air flow within the transparent cover 203.

Figure 8:
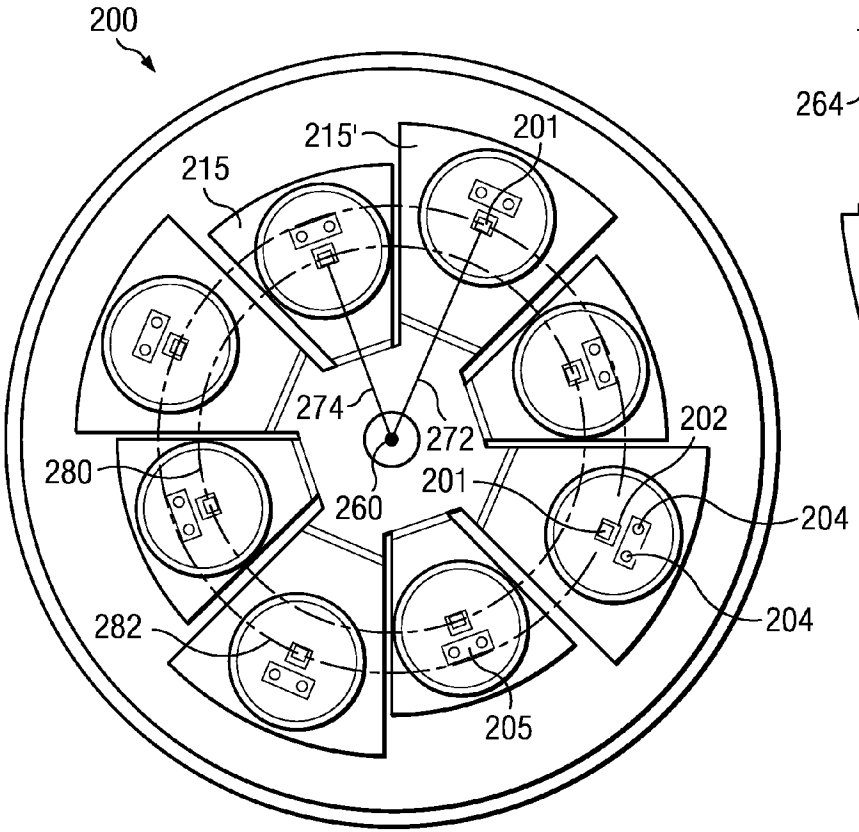
FIG. 8 is a drawing illustrating a top down view of the LED lamp shown in FIG. 6, in accordance with the present disclosure.

FIG. 8 is a drawing illustrating a top-down view of an embodiment of an LED lamp 200. The LED lighting elements 201 on the inclined planes 215 and 215' may be located on circles 280 and 282, which are of different radii. In other words, the distance 272 between the LED lighting elements 201 on inclined plane 215' and the longitudinal axis (shown in FIGS. 7 and 9) may be different than the distance 274 between LED lighting elements on inclined plane 215 and the longitudinal axis (shown in FIGS. 7 and 9). In an embodiment, the inclined planes 215, 215' are located at different distances from the central axis. In another embodiment, the inclined planes 215, 215' are located the same distance from the central axis, but are positioned at different inclination angles (shown in FIG. 9). The inclination angle of the inclined plane 215' may be greater than the inclination angle of the inclined plane 215. In an embodiment, the inclined planes 215, 215' of the two levels are positioned around the longitudinal axis (shown in FIGS. 7 and 9) in an interleaved manner, i.e. an LED lighting element 201 on one inclined plane 215 is located at a different radii and has a different inclination from an LED lighting element 201 on an adjacent inclined plane 215'. This arrangement of light emitted with varying light angles from adjacent inclined plans provides adequate illumination uniformity, enhances the average illumination intensity, and expands the overall illumination beam angle.

Electrical terminals 204 are connected to the LED lighting element 201, providing power. A holder 205 (discussed above in relation to FIG. 6), made of non-conductive materials, helps hold the LED stand 202 and the electric terminals 204 in position.

Figure 9:
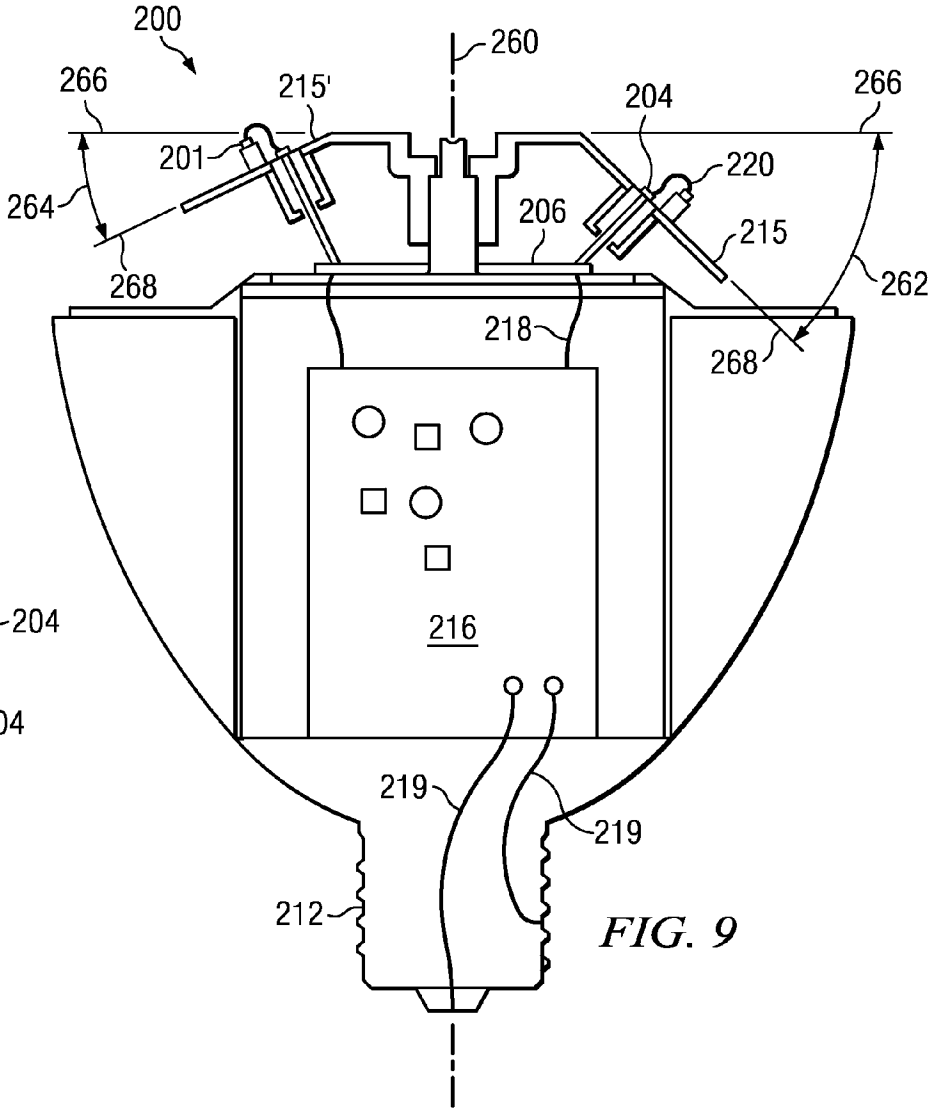
FIG. 9 is a schematic drawing illustrating internal circuit connections of the LED lamp shown in FIG. 6, in accordance with the present disclosure.

FIG. 9 is a drawing illustrating the internal electrical connections of an LED lamp 200. A DC circuit board 216 may be installed in the internal cavity of the LED lamp 200. The DC circuit board 216 may be a printed circuit board including an AC to DC converter. Such AC to DC converters are well known in the field. The DC circuit board 216 also includes a current-control part (not shown in FIG. 9) for each LED lighting element. The input terminal of the converter connects with the lamp holder 212 by a conducting wire 219 in order to receive an input AC current. The output terminal of the converter provides DC current to LED lighting elements 201 through a DC wire 218 and through a power wire interfaces 204 and bonding wires 220. Two DC wires 218 connect with a PCB, which provides power to the electrical terminals 204. A PCB 216 distributes power to the LED light elements.

FIG. 9 also illustrates the inclination angles 262 and 264 of inclined planes 215 and 215'. The inclination angles 262, 264 are the angles between a line 266 perpendicular to the longitudinal axis 260 of the LED lamp 200 and a line 268 parallel to the inclined plane 215. In an embodiment, inclination angle 262 of the first level of inclined planes are within the range of 10° to 80°. The inclination angle 264 of the second level of inclined planes may be set at a range between 10° and 80°, 20° and 70°, or 15° and 60° etc.

Figure 10:
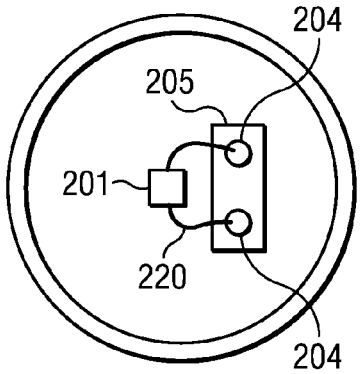
FIG. 10 is a drawing illustrating the electrical connections of the LED lamp shown in FIG. 6, in accordance with the present disclosure.

FIG. 10 illustrates the electrical installation of the LED lighting elements under transparent cover 203 (shown in FIGS. 6 and 7). LED lighting elements 201 are connected to two power wire interfaces 204 by two thin bonding wires 220 in order to draw power. The bonding wires 220 may be preferably commonly available wires. The LED wire interfaces 204 may be small metal rods embedded in an insulating material 205 and are electrically insulated from the substrate 208 (shown in FIGS. 6 and 7).

Figure 11:
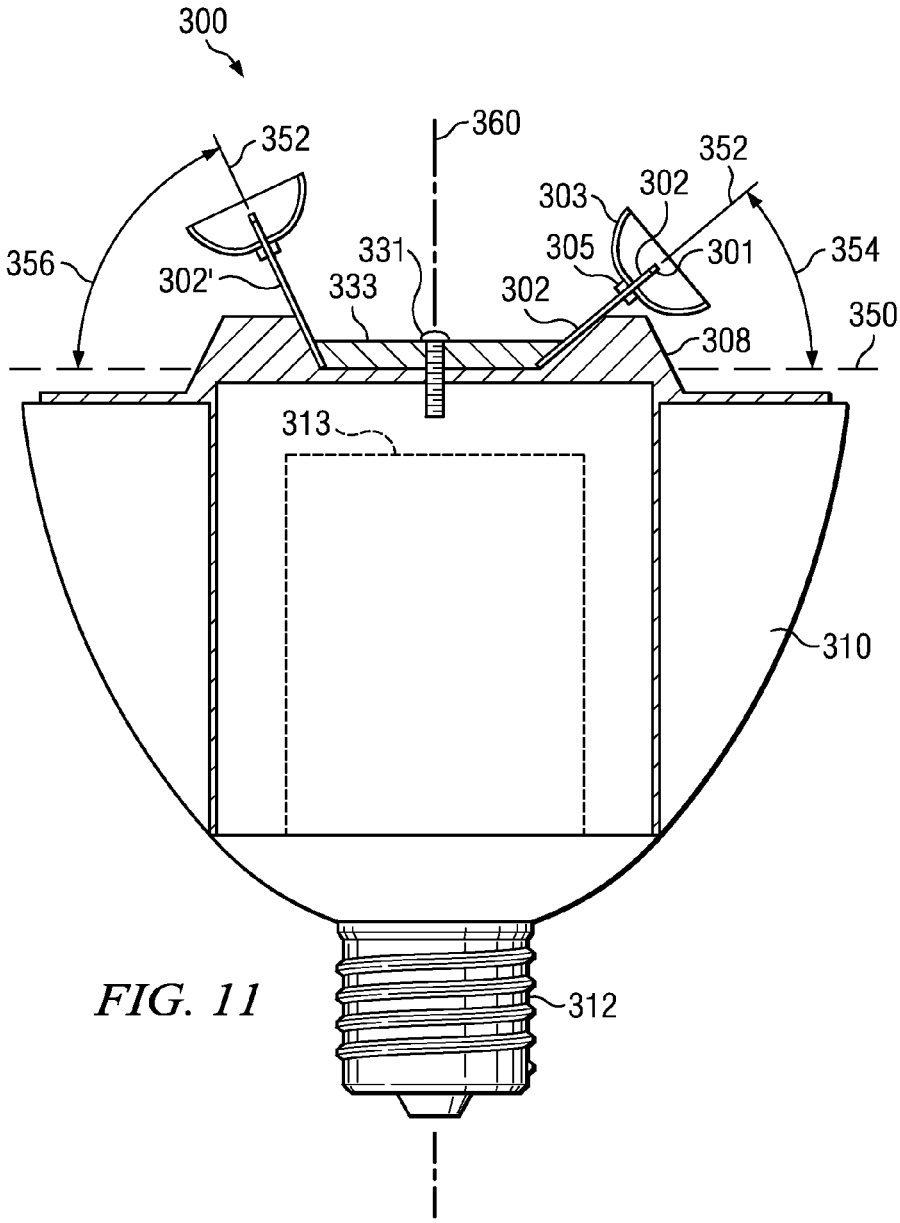
FIG. 11 is a cross-sectional side view drawing illustrating a side view of another LED lamp, in accordance with the present disclosure.

FIG. 11 is a drawing illustrating a side view of an embodiment of an LED lamp 300. A lamp holder 312 is connected to an alternating current (AC) power source to supply power to the LED lamp 300. The lamp holder 312 may be of the same outward form as common lighting lamps, making it easier to substitute the LED lamp in for a bulb currently used for household or other lighting applications. A substrate 308 is mechanically connected to the lamp holder 312. An internal direct current (DC) circuit board 313 is placed inside the substrate 308, and draws power from the lamp holder 312 to supply to the LED lighting elements 301.

The substrate 308 may be a cast-formed metal module. The substrate 308, which serves as a heat sink, may include a plurality of fins 310 for heat dissipation. The fins may be oriented on the sides 310 or top (not shown in FIG. 11) of the LED lamp 300 to facilitate air flow so that heat may be more effectively dissipated.

LED lighting elements 301 are installed on LED stands 302. The LED stands 302 may serve as an additional heat sink and are connected to substrate 308. A holder 305, made of non-conductive materials, helps hold the LED stand 302 and a reflective container 303 in position. In an embodiment, the LED stand 302 is fixed to the substrate 308 by placing it in a slot defined in the substrate 308 (not shown) which is made to accommodate the LED stand 302. A metal plate 333 is placed on the top side of the substrate 308 so that it keeps the LED stand 302 in good contact with the substrate 308. The metal plate 333 is secured by screw 331. LED stands 302 may be placed at different inclination angles 354, 356 with respect to the horizontal axis 350 parallel to the top surface of the substrate 308. The horizontal axis 350 is perpendicular to the longitudinal axis 360 of the LED lamp 300. The inclination angles 354, 356 are the angles between the horizontal axis 350 and a central axis 352 of the LED stand 302. The LED stand 302 may be made from any good heat conducting material. In an embodiment, LED stand 302 is made from the same material as substrate 308. In another embodiment, LED stand 302 is made from a different material as substrate 308, but both materials have good heat dissipation characteristics. The stand 302 may be positioned at a plurality of inclined angles 354, 356.

A container 303 cups around LED lighting element 301, which may provide protection for the LED lighting element 301 and the wiring. The interior of container 303 may be coated with a high gloss, reflective coating. The container 303 may be made from any materials commonly used in the art, and in an embodiment is made from plastic or nylon. In an embodiment, reflective container 303 is coated with a high gloss reflective coating. The reflective coating of container 303 may help to reflect and refract the light that is emitted from the LED lighting element 301 into usable output light. A holder 305 helps hold the LED stand 302, the electric terminals 304 and the reflective container 303 in their desired positions. The bottom of the container 303 includes an aperture defined therethrough. The prongs of LED stand 302 are disposed through the aperture and are held in place by the holder 305, e.g., in an embodiment, the holder 305 is a stopper and the prongs are disposed through and fit snugly in the stopper. The holder 305 is coupled to the container 303 by any mechanical coupling known in the art or by an adhesive. The perimeter of the aperture in the bottom of the container 303 may have a number of profiles, including an oblong profile. In another embodiment, the bottom of the container 303 includes three apertures defined therethrough. Each prong of the LED stand 302 are disposed through a different aperture and are held in place by the holder 305.

The LED stands 302 may be positioned in any pattern. In an embodiment, as shown in FIG. 1, two LED stands 302 and 302' are positioned at two different angles 356, 354, both within the range of 10° to 80° relative to the horizontal axis 350. Having the LED elements 301 mounted on the stands oriented at different angles allows the LED lamp 300 to provide a wider scope of light coverage.

Figure 12:
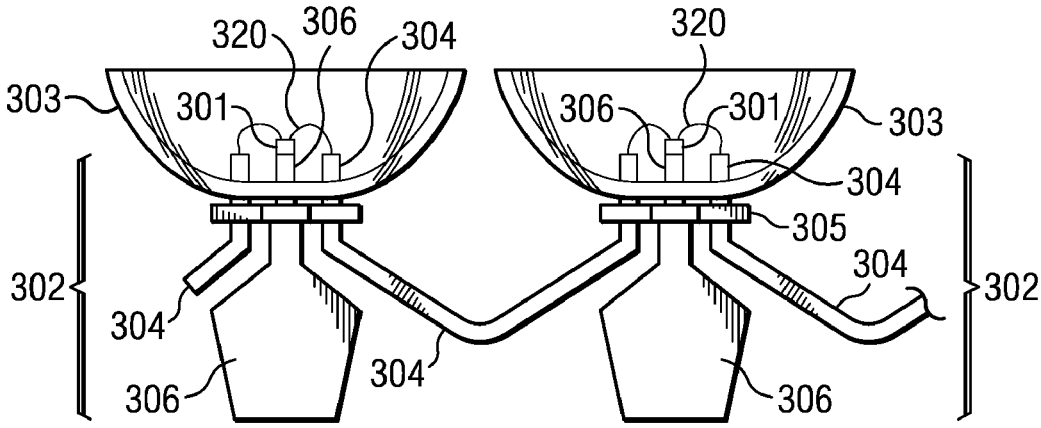
FIG. 12 is a drawing illustrating a side view of the LED stand shown in FIG. 11, in accordance with the present disclosure.

FIG. 12 is a drawing illustrating two LED stands 302, reflective containers 303, and the position of the LED lighting elements 301 and electrical terminals 304. The LED element 301 is mounted on the LED stand 302. Wires 320 connect electric terminals 304 to the LED lighting element 301. The wires 320 may be gold wires.

In an embodiment, the LED stand 302 is a metal frame, with a thickness of 0.5-3 mm. The LED stand 302 has three components, one component 306 for supporting LED lighting element 301, and the other two components 304 comprising electrical terminals 304, which supply electrical current to the LED lighting element 301. LED lighting element 301 is attached to the LED stand 302, and in an embodiment, is attached to the LED stand 302 via an adhesive paste with good heat-conducting properties, e.g. silver epoxy. This may provide good heat transfer from the LED lighting element 301 to the LED stand 302. Therefore, the LED stand 302 may serve as both a mechanical support and a heat conduit for the LED lighting element 301. In an embodiment, the LED lighting elements 301 are bare (i.e. without normal LED packaging apparatus such as the adhesive base, heat-dissipating substrate, pins, or glass fixture). Depending on the requirements on the output light intensity of the LED lamp, the number of LED elements 301, LED stands 302, and electric terminals 304 may be adjusted.

The LED lighting element 301 is mounted on the stand 302 and, thus, is raised above the substrate (shown in FIG. 11). The central supporting component of stand 302 (on top of which the LED lighting element 301 is mounted) may extend above the bottom of reflective container 303. In an embodiment, the central component may extend 0.5 to 3 millimeters above the bottom of reflective container 303. The terminals 304 may also rise above the bottom plane of reflective container 303. In an embodiment, the terminals 304 do not rise above the height of the LED lighting element 301.

A holder 305, made of non-conductive materials, helps hold the LED stand 302, the electric terminals 304 and the reflective container 303 in position. The LED stand 302 and two electric terminals 304, one positive terminal and one negative terminal, form a LED emitting unit (shown more clearly in FIG. 13). The positive electrical terminal of one LED emitting unit is connected with the negative terminal of an adjacent LED emitting unit. Thus, the LED emitting units are connected in series. The ends of the series connected LED emitting units connects to an internal DC supply board (shown in FIG. 14) via wires, so electric current may be supplied to the LED elements 301 via the electric terminals 304.

Figure 13:
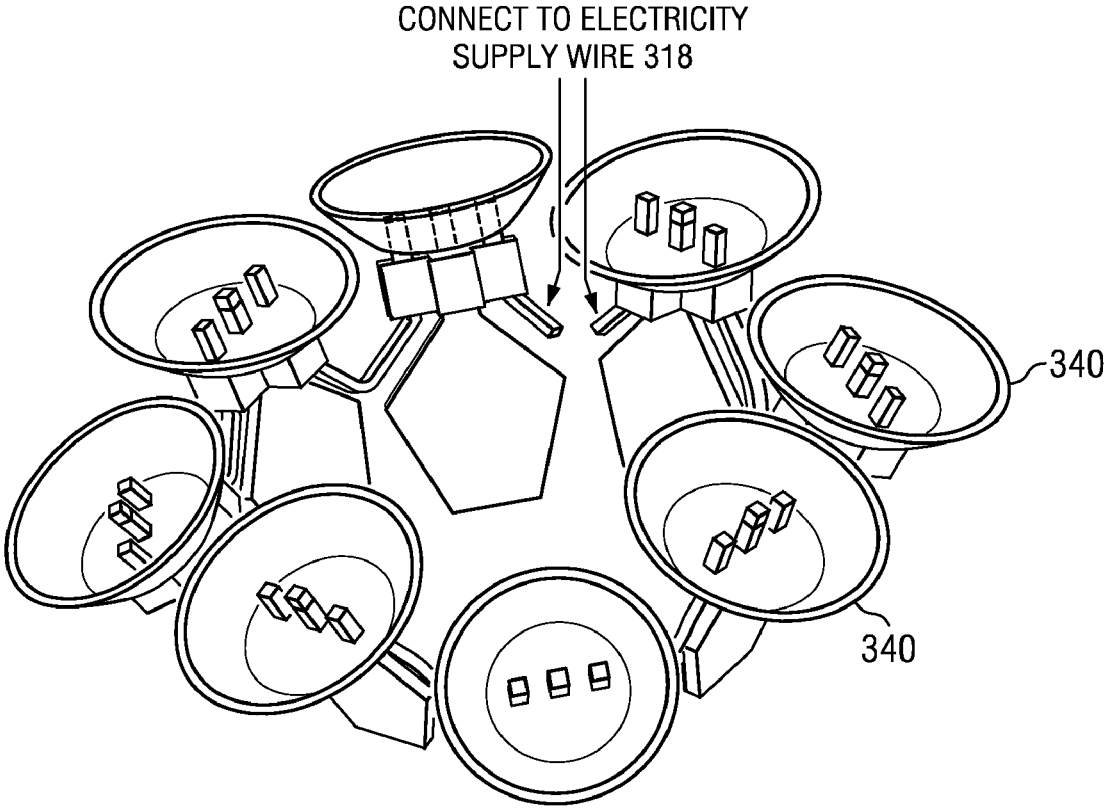
FIG. 13 is a drawing illustrating a perspective view of the LED stand shown in FIG. 11, in accordance with the present disclosure.

FIG. 13 is a drawing illustrating a series of LED emitting units 340 which are connected in series and ultimately connected to the electricity supply wire 318.

Figure 14:
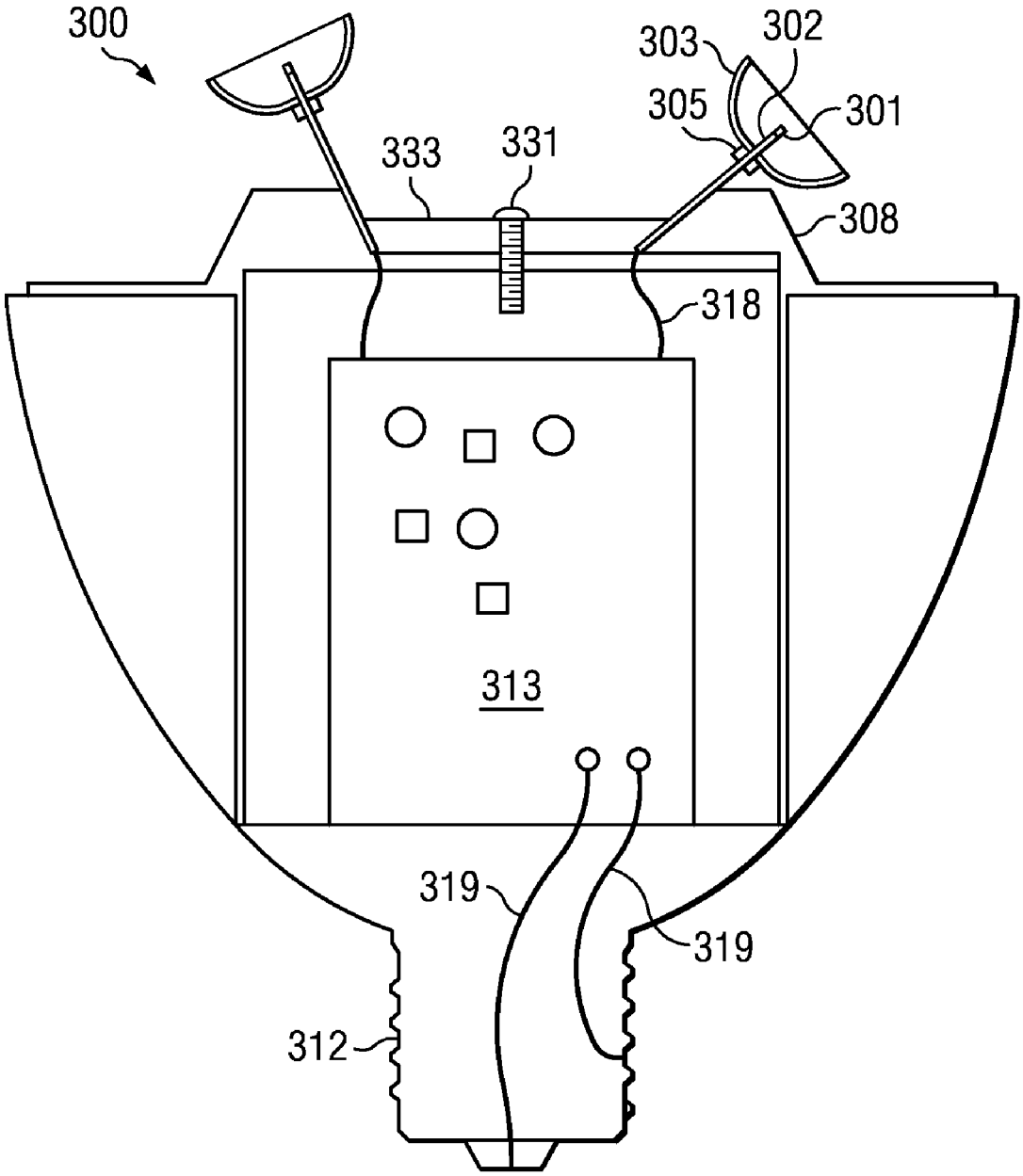
FIG. 14 is a drawing illustrating the electrical connections of the LED lamp shown in FIG. 11, in accordance with the present disclosure.

FIG. 14 illustrates the internal electrical connections of an embodiment of the LED lamp 300. A DC circuit board 313 may be installed in the internal cavity of the LED lamp 300. The DC circuit board 313 may be a PCB and would include an AC to DC converter. Such AC to DC converters are well known in the field. The DC circuit board 313 also includes a current-control part (not shown in FIG. 14) for each LED lighting element 301. The input terminal of the converter connects with the lamp holder 312 by a conducting wire 319 in order to receive an input AC current. The output terminal of the converter provides DC current to LED lighting elements 301 through DC wires 318, which connect to the ends of the series of LED emitting units. A holder 305, made of non-conductive materials, helps hold the LED stand 302, the electric terminals (not shown in FIG. 14), and the reflective cup 303 in position. A metal plate 333 is placed on the top side of the substrate 308 so that it keeps the LED stand 302 in good contact with the substrate 308. The metal plate 333 is secured by screw 331.

Figure 15:
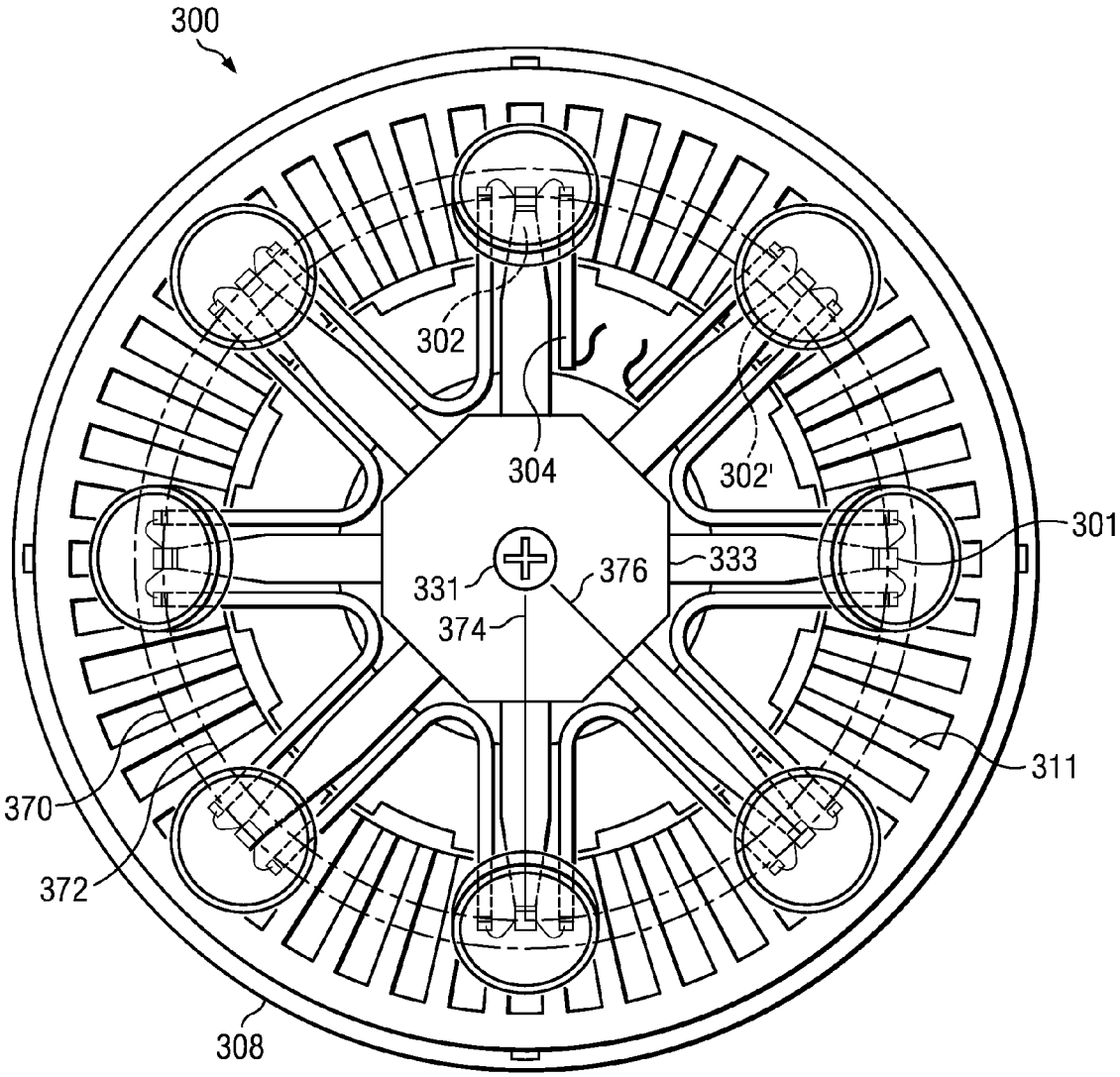
FIG. 15 is a drawing illustrating a top down view of the LED lamp shown in FIG. 11, in accordance with the present disclosure.

FIG. 15 is a drawing illustrating a top-down view of an embodiment of the LED lamp 300. Electric current may be supplied to the LED elements 301 via the electric terminals 304. The top of the substrate 308 may have fins 311 for heat dissipation. A metal plate 333 may be placed on the top side of the substrate 308 so that it keeps the LED stand 302 in good contact with the substrate 308. In an embodiment, the metal plate 333 is secured by screw 331. The LED lighting elements 301 on the LED stands 302 and 302' are located on circles 370, 372 of different radii 374, 376 around the longitudinal axis (shown in FIG. 11) of the LED lamp 300. In an embodiment, the distance 376 between the LED lighting elements on 302' and the longitudinal axis is greater than the distance 374 between LED lighting elements on 302 and the longitudinal axis. In another embodiment, the inclination angle (shown in FIG. 11) of the LED stand 302' is greater than the inclination angle of the inclined plane 302. In an embodiment, the positioning and orientation of the LED stands 302 are arranged in such a manner that each stand has a different inclination angle and different distance 374, 376 to the longitudinal axis (not shown) than the stands adjacent to it, but any two stands separated by one stand in between have the same inclination angle and the same distance 374, 376 to the longitudinal axis (not shown).

In an embodiment, LED stands 302 are placed in two levels, considering that LED stands 302 that are at a first distance 374 to the longitudinal axis are one level of LED stands and LED stands 302' at a second distance 376 to the longitudinal axis are a second level of LED stands. In an embodiment, the LED stands 302 are placed in an alternating pattern between the two levels, with the LED stands 302 and, thus, the LED lighting elements 301, at a first level substantially at a first orientation angle and the LED stands 302' and, thus, the LED lighting elements 301, at a second level substantially at a second orientation angle. As a result of such positioning, an LED lighting element 301 on one LED stand 302 is at a different distance 374 from the longitudinal axis (shown in FIG. 11) and has a different inclination angle (shown in FIG. 11) from the LED lighting element 301 on an adjacent LED stand 302', which is located at a second inclination angle and a second distance 376. This arrangement results in light emitted from one LED element being at an angle different from that of light emitted from adjacent LED elements, which provides adequate illumination uniformity, enhances the average illumination intensity, and expands the overall illumination beam angle.

While FIG. 15 illustrates an example of a two-level pattern for the positioning of the LED stands 302, persons skilled in the art will recognize that the actual pattern can be varied. For example, the pattern could include only one level. That is, all the stands 302 may be located the same distance from the longitudinal axis. Another embodiment may include all stands 302 located at the same distance to the longitudinal axis, but with different orientation angles. As another example, the pattern could include more than two levels. As a further example, the LED stands at any level do not have to be all at the same orientation angle. The pattern in which the LED stands 302 are positioned may be made simple or complex to meet output light preferences.

Figure 16:
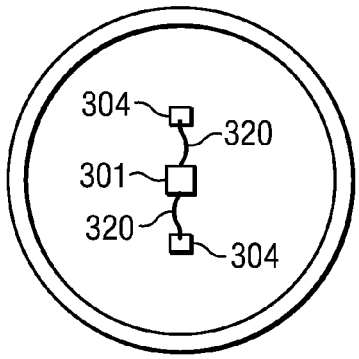
FIG. 16 is a drawing illustrating the electrical installation of LED lighting elements of the LED lamp shown in FIG. 11, in accordance with the present disclosure.

FIG. 16 is a drawing illustrating a close-up view of the electrical installation of an LED lighting element 301. The LED lighting element 301 is connected to two power wire electric terminals 304 by two thin bonding wires 320 in order to draw power. The bonding wires 320 are preferably commonly available wires. The LED wire interfaces 304 are metal conductors embedded in an insulating material 305 and are electrically insulated from the substrate.

Consistent with other embodiments discussed herein, mounting the LED lighting element 301 on an elevated platform, such as the central prong of LED stand 302, may allow the light output in the horizontal directions to be turned into useful light.

In an embodiment, the LED lamp implements a two-level heat dissipation mechanism, i.e. dissipation of heat in multiple stages. The LED stand 302 serves as a first level mechanism for heat dissipation (or a first level heat sink) and the substrate 308 serves as a second level mechanism (or a second level heat sink). In other words, the LED stand 302 provides a first stage of heat dissipation and the substrate 308 provides a second stage of heat dissipation to further lower the temperature of the LED lighting elements 301. This provides greater heat dissipation efficiency. Further, the LED stand 302 is free standing in the air and transfers heat to the air around it easily, further improving heat dissipation. Thus, the LED lamp 300 can dissipate the heat generated by the LED light element at a plurality of levels.

The two level heat dissipation mechanism may allow for the second level heat sink, substrate 308, to be maintained at a lower level than the temperature of the first-level heat sink, the LED stand 302, which may improve the safety profile of the LED lamp.

In an embodiment, the LED lamp 300 may be on continuously for a period of a week and the LED stand 302 may be kept at a temperature of up to 120° C., while the substrate 308 is maintained at a lower temperature level, below 90° C. Even after a period of a week, there is a temperature difference between the LED stand 302 and the substrate 308 of about 15 to 30° C.

While various embodiments in accordance with the principles disclosed herein have been described above, it should be understood that they have been presented by way of example only, and not limitation. Thus, the breadth and scope of the invention(s) should not be limited by any of the above-described exemplary embodiments, but should be defined only in accordance with any claims and their equivalents issuing from this disclosure. Furthermore, the above advantages and features are provided in described embodiments, but shall not limit the application of such issued claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, although the headings refer to a "Technical Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of such claims shall be considered on their own merits in light of this disclosure, but should not be constrained by the headings set forth herein.

What is claimed is:

1. An LED lamp, comprising:

a first level heat sink comprising a substrate;

a second level heat sink comprising at least one stand connected to the substrate; and at least one LED light element mounted on the at least one stand, wherein the at least one stand comprises a central longitudinal prong and two side longitudinal prongs, and further wherein the at least one LED light element is mounted on an end portion of the central longitudinal prong and the two side longitudinal prongs are connected to electrical terminals, the electrical terminals operable to provide current to the at least one LED light element.

2. The LED lamp of claim 1, wherein the substrate and the at least one stand cooperate to dissipate, at a plurality of levels, heat generated by the LED light element.

3. The LED lamp of claim 1, wherein the at least one stand comprises at least one prong, and further wherein the at least one LED light element is mounted on the at least one prong.

4. The LED lamp of claim 2, wherein the at least one LED light element is in an elevated position relative to the position of the substrate.

5. The LED lamp of claim 4, further comprising a container, wherein a bottom wall of the container comprises an aperture defined therethrough, and the at least one stand is disposed through the aperture of the bottom wall of the container, and further wherein the a surface of the bottom wall of the container is light-reflective, and further wherein the LED light element is in an elevated position relative to the bottom wall of the container.

6. The LED lamp of claim 1, further comprising:

a container, wherein a bottom wall of the container comprises an aperture defined therethrough, and the at least one stand is disposed through the aperture; and a holder coupling the at least one stand to the container;

wherein the container comprises a recessed area defined by the bottom wall and at least one sidewall, and further wherein the at least one sidewall of the container substantially encircles a top portion of the at least one stand and the at least one LED light element.

7. The LED lamp of claim 6, wherein the at least one sidewall of the container is substantially transparent.

8. The LED lamp of claim 6, wherein the container is made of a plastic material.

9. The LED lamp of claim 6, wherein the recessed area of the container is substantially filled with transparent silicon robber.

10. The LED lamp of claim 6, further comprising a glossy sheet laminated to a surface of the bottom wall of the container, wherein the glossy sheet is operable to reflect or refract light emitted from the LED light element.

11. The LED lamp of claim 10, wherein the sheet is colored.

12. The LED lamp of claim 1, wherein the at least one LED light element is coupled to the at least one stand by an adhesive.

13. The LED lamp of claim 1, wherein the at least one LED light element comprises first and second LED light elements and the at least one stand comprises first and second stands, the first LED light element being mounted on the first stand and the second LED light element being mounted on the second stand, the first and second stands each comprising a central axis; and further wherein the first stand is oriented at a different inclination angle than the second stand, the inclination angles of the first and second stands comprising an angle defined by a plane perpendicular to a longitudinal axis of the LED lamp and the central axes of the first and second stands, respectively.

14. The LED lamp of claim 1, further comprising a lamp holder connected to the substrate, the lamp holder being connected to an alternating current power source and operable to supply power to the LED lamp.

15. The LED lamp of claim 1, wherein the substrate is a east-formed metal module.

16. The LED lamp of claim 1, wherein the substrate includes a plurality of fins.

17. The LED lamp of claim 1, wherein the substrate comprises part of an outer surface of the LED lamp.

18. The LED lamp of claim 17, wherein the substrate is maintained at a lower temperature than the at least one stand and wherein the at least one stand provides a first level of heat dissipation for the at least one LED light element.

19. The LED lamp of claim 17, wherein the substrate is maintained a temperature that does not cause physical injury when touched.

20. The LED lamp of claim 17, wherein the substrate is maintained at a temperature below 90 degrees Celsius.

21. An LED lamp comprising:

at least one LED light element;

a first level heat sink comprising an LED support, wherein the at least one LED light element is mounted on the LED support;

a second level heat sink comprising a substrate, wherein the LED support is connected to the substrate, and wherein the LED support comprises at least one inclined plane;

two electrical terminals; and a holder disposed in a top portion of a recessed area of the inclined plane, the holder comprising at least one bore centrally defined therethrough; wherein a bottom wall of the recessed area of the inclined plane comprises a hole defined therethrough, and the hole of the recessed area is aligned with the bore of the holder and further wherein the two electrical terminals are disposed through the bore of the holder and the hole of the recessed area such that the two electrical terminals are electrically isolated from the inclined plane.

22. The LED lamp of claim 21, wherein the substrate and the at least one LED support cooperate to dissipate, at a plurality of levels, heat generated by the LED light element.

23. The LED lamp of claim 21, wherein the first level heat sink is made of a first material and further wherein the second level heat sink is made of a second material, and further wherein the first material and the second material comprise substantially the same material.

24. The LED lamp of claim 21, wherein the first level heat sink is made of a first material and further wherein the second level heat sink is made of a second material, and further wherein the first material and the second material comprise different materials.

25. The LED lamp of claim 21, wherein the at least one LED light element is a bare LED without packaging.

26. The LED lamp of claim 21, wherein the LED support and the substrate are made from the same material.

27. The LED lamp of claim 21, wherein the at least one inclined plane comprises a plurality of inclined planes arranged in an alternating two-level pattern, wherein adjacent inclined planes of the plurality of inclined planes have different inclination angles and arc oriented at different distances from a longitudinal axis of the LED lamp, and wherein every other inclined plane of the plurality of inclined planes have the same inclination angles and are oriented at a same distance from the longitudinal axis of the LED lamp, the inclination angles of the plurality of inclined planes each comprising an angle between a plane defined by a top surface of the support and a plane defined by each of the plurality of inclined planes.

28. The LED lamp of claim 21, wherein the at least one LED light element is mounted on the at least one inclined plane.

29. The LED lamp of claim 21, wherein the at least one inclined plane is electroplated.

30. The LED lamp of claim 21, further comprising at least one stand disposed on the at least one inclined plane, wherein the at least one LED light element is mounted on the at least one stand.

31. The LED lamp of claim 30, wherein the at least one stand comprises a plurality of stands and wherein one stand is mounted on each of the at least one inclined planes.

32. The LED lamp of claim 30, wherein the at least one stand is made of metal.

33. The LED lamp of claim 30, wherein the at least one LED light element is attached to the at least one stand via an adhesive.

34. The LED lamp of claim 30, wherein the at least one stand is disposed on a top surface of the at least one inclined plane such that the at least one LED light element is elevated above the at least one inclined plane.

35. The LED lamp of claim 34, further comprising at least one cover disposed over the at least one LED light element and the at least one stand, wherein the at least one cover is connected to the at least one inclined plane.

36. The LED lamp of claim 35, wherein the at least one cover comprises a plurality of covers, and wherein one cover is positioned over each of the at least one LED light elements and the at least one stand.

37. The LED lamp of claim 35, wherein the at least one cover comprises at least one slot defined therethrough, the slot operable to allow air circulation within the at least one cover.

38. The LED lamp of claim 35, wherein the at least one cover is substantially transparent.

39. The LED lamp of claim 21, wherein the LED support and the substrate are spaced apart by a distance.

40. The LED lamp of claim 21, wherein the substrate is maintained at a lower temperature than the LED support.

41. The LED lamp of claim 21, wherein the substrate comprises a plurality of fins.

42. The LED lamp of claim 21, wherein the substrate is a cast-formed metal module.

43. The LED lamp of claim 21, wherein the substrate is maintained a temperature below 90 degrees Celsius.

44. An LED lamp, comprising:

at least one LED emitting unit, the at least one LED emitting unit comprising:

an LED stand; and two electrical terminals;

at least one LED light element mounted on the LED stand a substrate comprising at least one slot defined therein, wherein a bottom portion of the LED stand of the at least one LED emitting unit is inserted into the slot; and a metal plate positioned on top of the substrate, wherein the metal plate is operable to hold the stand in a desired orientation.

45. The LED lamp of claim 44, wherein the substrate and the at least one LED emitting unit cooperate to dissipate heat at a plurality of levels, such that the at least one LED emitting unit is operable to provide a first level of heat dissipation for the at least one LED light element and the substrate is operable to provide a second level of heat dissipation for the at least one LED light element.

46. The LED lamp of claim 44, wherein the substrate comprises a plurality of fins.

47. The LED lamp of claim 44, further comprising a lamp holder connected to an alternating current power source and operable to supply power to the LED lamp, wherein the substrate is connected to the lamp holder.

48. The LED lamp of claim 44, wherein one LED light element is disposed on the LED stand of the at least one LED emitting unit.

49. The LED lamp of claim 44, wherein the substrate is a east-formed metal module.

50. The LED lamp of claim 44, further comprising:

a reflective container, wherein a curved bottom wall of the container comprises an aperture defined therethrough, and a prong of the LED stand of the at least one LED emitting unit is disposed through the aperture; and a holder coupling the LED stand of the at least one LED emitting unit to the container;

and wherein the container comprises a recessed area defined by the curved bottom wall and at least one sidewall, and further wherein the at least one side wall of the container substantially encircles a top portion of the LED stand of the at least one LED emitting unit and the at least one LED light element.

51. The LED lamp of claim 50, wherein the reflective container comprises a cup-like container.

52. The LED lamp of claim 50, wherein the reflective container is made of plastic.

53. The LED lamp of claim 50, wherein an interior surface of the reflective container is electroplated.

54. The LED lamp of claim 44, wherein the LED stand and the substrate are made from the same material.

55. The LED lamp of claim 44, wherein a first LED stand of a first LED emitting unit is oriented at a first inclination angle and a second stand of a second LED emitting unit is oriented at a second inclination angle, wherein the first and second inclination angles comprise angles defined by a plane perpendicular to a longitudinal axis of the LED lamp and the central axes of the first and second LED stands, respectively.

56. The LED lamp of claim 55, wherein the first inclination angle and the second inclination angle are different.

57. The LED lamp of claim 55, wherein the at least one LED emitting unit are arranged in an alternating two-level pattern, wherein the LED stands of adjacent units of the at least one LED emitting unit have different inclination angles and are oriented at a different distance from the longitudinal axis of the LED lamp, and wherein the LED stands of every other units of the at least one LED emitting unit have the same inclination angles and are oriented a same distance form the longitudinal axis of the LED lamp pattern.

58. The LED lamp of claim 44, wherein the LED stand is made of metal.

59. The LED lamp of claim 44, wherein the at least one LED light element is a bare LED without packaging.

60. The LED lamp of claim 44, wherein the at least one LED light element is attached to the LED stand of the at least one LED emitting unit via an adhesive.

61. The LED lamp of claim 44, wherein the LED stand of the at least one LED emitting unit is operable to elevate the at least one LED light element above the substrate.

62. The LED lamp of claim 61, further comprising a reflective container wherein the stand of the at least one LED light emitting unit is disposed through an aperture defined in a bottom wall of the reflective container, and wherein the LED light element is in an elevated position relative to the bottom wall of the reflective container.

63. The LED lamp of claim 44, wherein each of the at least one LED emitting unit is connected in series to an adjacent LED emitting unit of the at least one LED emitting unit, thereby forming a series connected LED emitting chain, and further wherein ends of the series connected LED emitting chain are connected to an internal DC supply board.

64. The LED lamp of claim 44, wherein the substrate comprises a portion of an outer surface of the LED lamp.

65. The LED lamp of claim 64, wherein the substrate is maintained at a lower temperature than the at least one LED emitting unit and wherein the at least one LED emitting unit provides a first level of heat dissipation for the at least one LED light element.

66. An LED lamp, comprising:

a first level heat sink comprising a substrate;

a second level heat sink comprising at least one stand connected to the substrate; and at least one LED light element mounted on the at least one stand, wherein the at least one stand comprises a plurality of stands, the plurality of stands being arranged in a pattern and each having a central axis, the pattern comprising an alternating two-level pattern such that adjacent stands of the plurality of stands have different inclination angles and are oriented at a different distance from a longitudinal axis of the LED lamp, and wherein every other stand of the plurality of stands have the same inclination angles and are oriented at a same distance from the longitudinal axis of the LED lamp, the inclination angles of the plurality of stands each comprising an angle defined by the central axis of each of the plurality of stands and a plane perpendicular to a longitudinal axis of the LED lamp.

* * * * *